US005378576A

United States Patent [19]

Sakai et al.

[11] Patent Number: 5,378,576

[45] Date of Patent: Jan. 3, 1995

[54] ELECTROPHOTOGRAPHIC TRANSFER FILM AND PROCESS FOR FORMING IMAGE

[75] Inventors: Takashi Sakai; Kishio Jinbo, both of Minami-ashigara; Koichi Makiyama, Ebina; Masahiko Kubo, Ebina; Yoshio Shoji, Ebina; Kazuo Asaka, Ebina; Yutaka Sugizaki, Ebina; Tsukasa Matsuda, Ebina, all of Japan

[73] Assignees: Fuji Xerox Co., Ltd., Tokyo; Fuji Photo Film Co., Ltd., Kanagawa, both of Japan

[21] Appl. No.: 242,055

[22] Filed: May 13, 1994

Related U.S. Application Data

[63] Continuation of Ser. No. 881,701, May 12, 1992, abandoned.

[30] Foreign Application Priority Data

May 14, 1991 [JP] Japan ..... 3-137040
Jan. 20, 1992 [JP] Japan ..... 4-027556

[51] Int. Cl.[6] ..... G03G 13/16
[52] U.S. Cl. ..... 430/126; 428/195
[58] Field of Search ..... 430/126, 45; 428/195

[56] References Cited

U.S. PATENT DOCUMENTS 5,106,710 4/1992 Wang et al. ..... 430/45
5,137,773 8/1992 Malhotra ..... 428/215

FOREIGN PATENT DOCUMENTS 51-34734 3/1976 Japan .
59-184361 10/1984 Japan .
60-52861 3/1985 Japan .
61-36756 2/1986 Japan .
61-36762 2/1986 Japan .
63-80273 4/1988 Japan .
2-263642 10/1990 Japan .

*Primary Examiner*—John Goodrow
*Attorney, Agent, or Firm*—Oliff & Berridge

[57] ABSTRACT

An electrophotographic transfer film is provided for use in an electrophotographic process in which a charged toner is adsorbed by an electrostatic latent image retaining unit and then transferred to a transfer film, in which a transparent resin layer which exhibits a compatibility with the binding resin for the toner to be fixed at the toner fixing temperature and a lower apparent melt viscosity than the toner biding resin at the toner fixing temperature is provided on at least one side of a plastic film having a heat resisting temperature of 100° C. or higher.

17 Claims, 2 Drawing Sheets

ELECTROPHOTOGRAPHIC TRANSFER FILM AND PROCESS FOR FORMING IMAGE

This is a continuation of application Ser. No. 07/881,701 filed May 12, 1992, now abandoned.

FIELD OF THE INVENTION

The present invention relates to an electrophotographic transfer film for carrying a toner image formed by electrophotography. The present invention also relates to an image formation process for the formation of an image on an electrophotographic transfer film.

BACKGROUND OF THE INVENTION

In recent years, it has been a wide practice that a transparent film on which a toner image had been formed by electrophotography is applied to an OHP (overhead projector) to project the image.

In an electrophotographic system, discharging is conducted, for example, charging a transfer film at a high voltage when a toner on an electrostatic latent image is transferred to the transfer film. Therefore, if the surface resistance of the film is high, a discharging mark occurs on the film in the copying machine. In order to present the discharging mark, it has been proposed that the surface resistance of the transfer film be controlled to a predetermined range.

However, a full-color image system wherein four color toners are transferred has a problem that if the surface resistance of the transfer film is too low, a toner which has been early transferred leaks charge onto the transfer film, reducing its adhesion to the transfer film, and is then transferred back to the electrostatic latent image retaining unit upon the subsequent toner transfer, causing color loss or deterioration of image quality and density.

Further, in the conventional electrophotography, since the interface of the toner with air gives a great refraction of incident light beam, only a dark image for projection with a low saturation can be obtained.

In order to overcome these difficulties, it is necessary that the roughness of the toner image formed on the transparent film be minimized. Many approaches have been heretofore proposed as discussed below. However, these approaches are not perfect solutions to the above mentioned problems.

JP-B-51-34734 (the term "JP-B" as used herein means an "examined Japanese patent publication") discloses that the optimum surface resistivity of a black-and-white electrophotographic transfer film is in the range of $10^{10}$ to $10^{12}$ Ω. However, in a full-color system, if the surface resistivity is simply lowered, retransfer will occur at $10^{11}$ Ω. Furthermore, if the optimum surface resistivity is limited to $10^{12}$ Ω, the range of the optimum surface resistivity is extremely limited in JP-B-51-34734 and a full-color system.

JP-A-59-184361 (the term "JP-A" as used herein means an "unexamined published Japanese patent application") proposes an approach in which a lacquer is spray-coated onto the surface of a toner image. However, this approach is disadvantageous in that the solvent for lacquer dissolves the toner, causing a drop in the image sharpness, unevenness of color or stain on non-image portion.

JP-A-60-52861 proposes an approach in which a toner image is covered with a laminated film. JP-A-61-36756 and 61-36762 propose an approach which comprises laminating a transparent film on a toner image, fixing the lamination through heat rolls, and then peeling the transparent film.

However, these approaches are disadvantageous in that they require a large number of processing steps following the image formation or cause destruction of the toner image upon peeling of the transparent film.

JP-A-63-80273 proposes an approach which comprises fixing at a temperature high enough to dissolve a toner, an approach which comprises fixing with a solvent such as toluene, an approach which comprises polishing the surface of a fixed image, and an approach which comprises coating the fixed toner image with a transparent coating which does not dissolve the toner.

However, in the case of roller fixing at an elevated temperature, when it is intended to minimize the roughness of a portion with less toner such as halftone portion, an offset will occur at a high density portion with much toner. In the case using a non-contact heat fixing apparatus such as oven, surge will occur in the transparent film, and a considerable period of fixing time is required to obtain an image having a sufficient transmission.

In the case of the approach with solvent fixing, when the fluidity of the toner is increased to an extent such that the toner roughness of the halftone portion is decreased, image collapse or running will occur at a high density portion.

In the case of the approach which comprises polishing the surface of an image, although the transmission can be increased at a portion with a relatively large amount of a toner, the toner roughness cannot be sufficiently reduced at a low density portion.

In the case of the approach which comprises coating the toner image with a transparent coating which does not dissolve the toner, a definite interface may occur on the toner grains and toner image, disadvantageously scattering the incident light beam and thus giving a dark image for projection with a low saturation.

JP-A-2-263642 proposes an approach for minimizing the roughness of a toner image formed on a transparent film which comprises providing, on the transparent film, a transparent resin layer compatible with a toner binding resin and having a greater storage elastic modulus than the toner binding resin at the toner fixing temperature. However, in this approach, since the storage elastic modulus of the transparent resin layer is greater than that of the toner binding resin, the toner can hardly sink in the transparent resin layer or hardly diffuse horizontally. In order to minimize the roughness of the toner image, it is necessary that the transparent resin layer be sufficiently thick and the toner be forced to sink in the transparent resin layer under pressure by a heat roller having a high hardness. The increase in the thickness of the transparent resin layer causes image blurring or distortion or image cracking by bending. The forced fixing by a heat roller having a high hardness causes wrinkling upon fixing, curling after fixing, etc.

Moreover, in the digital color image formation system, various color densities are given by changing the area of fine dots or lines. Therefore, the surface of a toner forming an image can be sufficiently smoothed at a high density portion by a heat roll fixing apparatus, but the roughness of the halftone portion due to the configuration of dot or line image is too large to smooth sufficiently. Thus, the refraction of the incident light beam gives a dark image with a low saturation at a halftone portion in the image for projection. When a natural image such as photograph is reproduced, a shadow which is not present in the original (hereinafer referred to as "pseudo-outline") is formed at the halftone portion.

In order to eliminate pseudo-outline which often occurs in the digital color image formation system, it is necessary that a toner image be allowed to sufficiently sink in the transparent resin layer on the transparent film or to diffuse horizontally. In the case of the approach as proposed in the above cited JP-A-2-263642, which comprises providing on the transparent film a transparent resin having a greater storage elastic modulus than the toner binding resin, the toner image can hardly sink in the transparent resin layer or hardly diffuse horizontally in the transparent resin layer, making it impossible to sufficiently reduce the roughness of the toner image at the halftone portion. Therefore, this approach can hardly inhibit the generation of pseudo-outline.

SUMMARY OF THE INVENTION

It is therefore an object of the present invention to overcome these prior art difficulties and thus provide an electrophotographic transfer film which can inhibit toner retransfer as well as generation of discharge mark, exhibits a wide range of optimum surface resistance and can provide a color image free from pseudo-outline for projection with a high saturation and brightness and an excellent color tone reproducibility in a simple method and a process for the formation of an excellent color image on said transfer film.

It is another object of the present invention to provide an electrophotographic transfer film which can form an excellent full-color image for projection thereon.

It is another object of the present invention to provide an electrophotographic transfer film which exhibits a reduced surface resistivity to inhibit toner retransfer.

It is another object of the present invention to provide an electrophotographic transfer film which can forth a full-color image for projection with a high lightness and saturation thereon.

It is another object of the present invention to provide an electrophotographic transfer film which exhibits an excellent full-color image reproducibility.

It another object of the present invention to provide an electrophotographic transfer film which eliminates pseudo-outline which occurs when a color image is formed in a digital system.

It is another object of the present invention to provide an electrophotographic transfer film which exhibits an excellent fixability of a full-color toner image.

It is another object of the present invention to provide an electrophotographic transfer film which can form an excellent full-color image for projection thereon in a simple process.

It is another object of the present invention to provide an image formation process for the formation of an excellent full-color image for projection on an electrophotographic transfer film by a simple procedure.

The present inventors have made an extensive study on the elimination of toner retransfer from the standpoint of the leakage of electric charge from toner and the adhesion between the toner and the transfer film. As a result, it has been found that the adhesion between the toner and the surface of the transfer film can be improved by using an antistatic agent having an electric charge with polarity opposite to the electric charge of the toner. It has been also found that the adhesion between the toner and the surface of the transfer film can be improved by providing on the transfer film a polymer layer having a good compatibility with the toner binding resin.

The inventors also made a study on the improvement in the saturation, lightness, color tone reproducibility and fixing of color images for projection and the elimination of pseudo-outline therefrom from the standpoint of the characteristics and amount of the resin incorporated in the electrophotographic transfer film. As a result, it has been found that the foregoing diffuculties can be drastically eliminated by using an electrophotographic transfer film comprising a transparent resin layer which exhibits a compatibility with the toner binding resin and a lower viscosity than the toner binding resin at the fixing temperature. Thus, the present invention was completed.

The present invention concerns an electrophotographic transfer film for use in an electrophotographic process in which a charged toner is adsorbed by an electrostatic latent image retaining unit and then transferred and fixed to the transfer film, the transfer film comprising a plastic film having a heat resisting temperature of 100° C. or higher having on at least one side thereof a transparent resin layer which exhibits a compatibility with a binding resin contained in the toner to be fixed at the toner fixing temperature and a lower apparent melt viscosity than the binding resin at the toner fixing temperature.

In a preferred embodiment of the present invention, the transparent resin layer has molten toner inclination angle of 40 degrees or less with the toner to be fixed at the toner fixing temperature and an apparent melt viscosity of from $1\times10^3$ to $7\times10^4$ poise at 100° C.

The present invention also provides a process for forming an image comprising the steps of: adsorbing a charged toner on an electrostatic latent image retaining unit, and transferring and fixing the charged toner to the above-described electrophotographic transfer film, the transferring and fixing being conducted twice or more.

In another preferred embodiment of the present invention, the transparent resin layer comprises an antistatic agent having an electric charge with polarity opposite to the electric charge of the toner. That is, in this embodiment, the transparent resin layer comprises a cationic antistatic agent when the toner is negatively charged, whereas the transparent resin layer comprises an anionic antistatic agent when the toner is positively charged.

BRIEF DESCRIPTION OF THE DRAWINGS

By way of example and to make the description more clear, reference is made to the accompanying drawings in which.

DETAILED DESCRIPTION OF THE INVENTION

Figure 1:
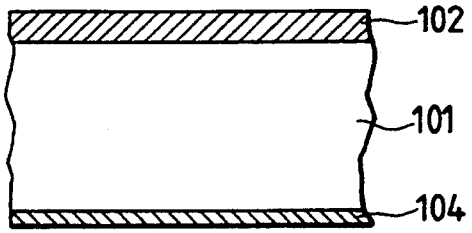
FIG. 1 is a schematic section of an electrophotographic transfer film according to one embodiment of the present invention.
Figure 2:
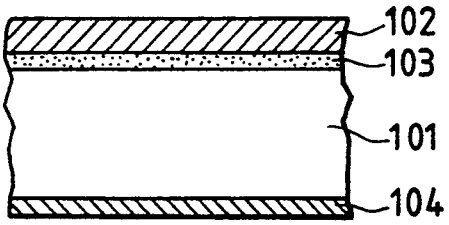
FIG. 2 is a schematic section of an electrophotographic transfer film according to another embodiment of the present invention.
Figure 3:
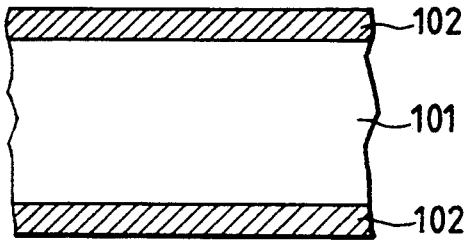
FIG. 3 is a schematic section of an electrophotographic transfer film according to another embodiment of the present invention.
Figure 4:
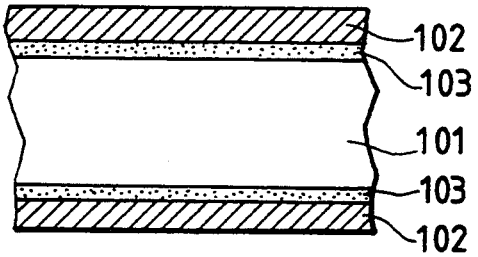
FIG. 4 is a schematic section of an electrophotographic transfer film according to another embodiment.

FIGS. 1, 2, 3 and 4 illustrate schematic sections of examples of an electrophotographic transfer film of the present invention. Numerals 101 and 102 in these drawings denote a plastic film and a transparent resin layer, respectively. In FIGS. 1 and 2, sliding layer 104 is provided on the opposite side to the transparent resin layer 102. In FIGS. 2 and 4, intermediate adhesion layer 103 is provided interposed between plastic film 101 and transparent resin layer 102.

In the electrophotographic transfer film of the present invention, specific examples of plastic film 101 include a polyethylene terephthalate film, a polysulfone film, a polyphenylene oxide film, a polyimide film, a polycarbonate film, a cellulose ester film and a polyamide film each having a heat resisting temperature of 100° C. or higher. Particularly preferred among these plastic films is a polyethylene terephthalate film in the light of heat resistance and transparency.

If the plastic film has a heat resisting temperature of lower than 100° C., it deforms when the toner is heat-fixed and thus cannot be put into practical use. The thickness of the plastic film is preferred to be such that no wrinkling occur when the film is softened by heat upon heat fixing. The thickness of the film is generally 50 μm or more, and preferably 75 μm or more. In the light of reduction of light transmittance, the upper limit of the thickness of the plastic film is generally 200 μm or less, and preferably 150 μm or less. Therefore, the thickness of the heat resistant plastic film is generally within a range of from 50 to 200 μm, and preferably from 75 to 150 μm.

The transparent resin layer improves the saturation, lightness and color reproducibility of a fixed color image and inhibits the generation of pseudo-outline. The transparent resin layer is required to be compatible with the binding resin contained in the toner to be used for the formation of a color image at the heat-fixing temperature and exhibit a lower apparent melt viscosity than the toner binding resin at the toner fixing temperature so as to cause the toner to sink therein sufficiently.

If the apparent melt viscosity of the resin to be used for the transparent resin layer is greater than that of the toner binding resin, the toner cannot sufficiently sink in the transparent resin layer when the toner image formed on the transparent resin layer is heat-fixed under pressure by a heat roll, leaving the surface of the toner image rough and thus causing a deterioration in the saturation of the image for projection that results in pseudo-outline.

A specific example of the resin to be used for the transparent resin layer include a polyester resin comprising a bisphenol derivative represented by formula (I) or a substituted compound of a bisphenol derivative represented by formula (I) as a diol component and at least one of 2 or more valent carboxylic acid, its anhydride and its lower alkyl ester as an acid component:

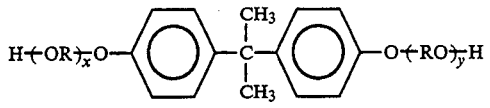

(I)

wherein R represents an ethylene group or a propylene group; and x and y each represents an integer of 1 or more, provided that the average of the sum of x and y is from 2 to 10.

The compatibility with the toner binding resin means that the resin in the transparent resin layer and the toner binding resin do not form any distinct interface in the fixed image. As a method for the evaluation of the compatibility with the toner binding resin, a solubility parameter has been known as disclosed in JP-A-2-263642. As a result of the investigation by the present inventors, however, this evaluation method is not necessarily suitable as a method for evaluation of compatibility upon heat fixing.

The inventors found "molten toner inclination angle" as a new method for correctly evaluating the compatibility with the toner binding resin. The method for the measurement of "molten toner inclination angle" will be described hereinafter.

Method for Measuring Molten Toner Inclination Angle

1. Formation of Toner Disc

Figure 6:
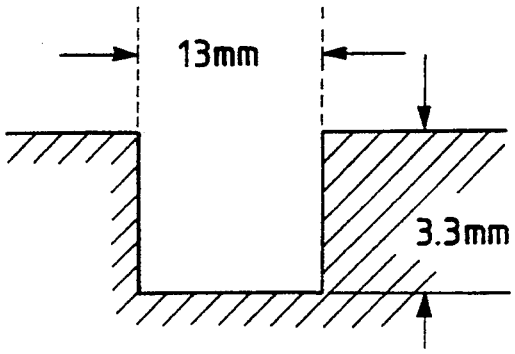
FIG. 6 is a section of a pellet frame for the formation of a toner disc for use in the measurement of molten toner inclination angle.

A concave pellet frame with an inner diameter of 13 mm and a height of 33 mm (FIG. 6) in Type SSP-10 Handpress (pellet former produced by Shimadzu Seisakusho Ltd.) is filled with a powdered toner. The powdered toner is then pressed by a handpress under pressure of 1 ton for 1 minute to form a toner disc.

Figure 7:
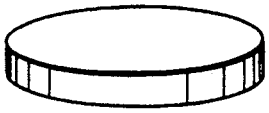
FIG. 7 is a perspective view of a formed toner disc for use in the measurement of molten toner inclination angle.

The standard toner disc thus formed has a diameter of 13 mm, a thickness of 1.2 mm and a weight of 0.183 g (see FIG. 7).

2. Melting and Solidification of Toner

Figure 8:
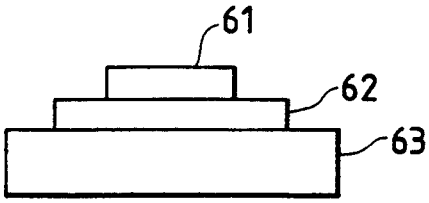
FIG. 8 is a schematic section of a melting-solidifying apparatus for a toner disc for use in the measurement of molten toner inclination angle.

A transfer film which has been set to a predetermined temperature and the toner disc are placed as shown in FIG. 8. The toner is then allowed to melt in 1 minute (For example, if the fixing roll temperature is 150° C. and the temperature of the transparent resin layer in the transfer film is 100° C., the measurement is effected at 100° C.). FIG. 8 illustrates the situation in which transfer film 62 and toner disc 61 are placed on hot plate 63. Thereafter, the material is placed on an aluminum plate having a thickness of 5 mm and a size of 20 mm×297 mm for 1 minute so that it is rapidly cooled and solidified.

3. Measurement of Molten Toner Inclination Angle

Using a contact angle measuring instrument produced by Kyowa Kaimen Kagaku K.K., the content angle at the foot of the toner thus solidified is twice measured. The measured values are then averaged to give the melt toner inclination angle.

In the case where the resin to be used for the transparent resin layer is selected from the standpoint of molten toner inclination angle, a resin which causes the toner to exhibit a molten toner inclination angle of 40 degrees or less with respect to the transparent resin layer is preferably used. Examples of the resin to be used for the transparent resin layer which exhibits a molten toner inclination angle of 40 degrees or less include can be used a thermoplastic resin such as polyester resin, styrene-acryl ester resin, epoxy resin, polyurethane resin, polymethyl methacrylate resin, vinyl chloride resin and vinyl chloride-vinyl acetate copolymer in addition to the above polyester resins comprising a bisphenol derivative and the above polyester resin comprising its substituted compound and 2 or more valent carboxylic acid, etc. In particular, a resin of the same kind as the main resin of the toner (resin contained in the toner in an amount of 50% by weight based on the total binding resin) may be preferably used. For example, if the main resin of the toner is a polyester resin, a polyester resin may be preferably used as the resin in the transparent resin layer; and if the main resin of the toner is a styrene-acryl ester resin, a styrene-acryl ester resin may be preferably used as the resin in the transparent resin layer.

The preferred characteristics of the resin to be used for the transparent resin layer are a molten toner inclination angle of 40 degrees or less and an apparent melt viscosity lower than the toner binding resin at the fixing temperature.

The apparent melt viscosity can be determined as follows. That is, using Type CFT-500A flow tester produced by Shimadzu Seisakusho K.K., the specimen is previously heated to an initial predetermined temperature of 80° C. for 300 seconds, and then the temperature of the specimen is increased at a constant rate of 5° C./min. in a die having a diameter of 0.5 mm and a thickness of 1.0 mm under pressure of 100 kg. During this process, the specimen is measured for apparent melt viscosity at various temperatures. The apparent melt viscosity of the toner and the transparent resin layer at the fixing temperature during the heat fixing is defined as the apparent melt viscosity at the fixing temperature. For example, if the fixing roll is 150° C., and the fixing is effected when the surface temperature of the transfer film is 100° C., the apparent melt viscosity at 100° C. is defined as the apparent melt viscosity at the fixing temperature.

The apparent melt viscosity of the resin in the transparent resin layer at a fixing temperature of 100° C. depends on the melt viscosity of the toner to be used. If a sharp-melting toner is used in the color image formation process, a resin having an apparent melt viscosity of $1\times10^3$ to $7\times10^4$ poise, preferably $5\times10^3$ to $4\times10^4$ poise may be used. If a resin having an apparent melt viscosity of less than $1\times10^3$ poise at 100° C. is used as the resin in the transparent resin layer, the transparent resin layer is diadvantageously peeled off the plastic film when the toner image is fixed by the heat roll. If a resin having an apparent melt viscosity of more than $7\times10^4$ poise at 100° C. is used as the resin in the transparent resin layer, the toner image sinks in the transparent resin layer to an extremely small extent even when the toner image is fixed by the heat roll, reducing the saturation of the image for projection and causing pseudo-outline. The optimum thickness of the transparent resin layer depends on the grain diameter of the toner to be fixed. If the color image formation process of the present invention is used, the thickness of the transparent resin layer is preferably in the range of 1 to 8 μm.

In the present invention, the transparent resin layer preferably contains an antistatic agent having an electric charge with polarity opposite to the electric charge of the toner. That is, in this embodiment, the transparent resin layer comprises a cationic antistatic agent when the toner is negatively charged, whereas the transparent resin layer comprises an anionic antistatic agent when the toner is positively charged.

In the conventional black-and-white electrophotographic process, if a selenium photoreceptor is used, it has been a general practice that the photoreceptor is positively charged while the toner is negatively charged. As an organic photoreceptor has been developed, it has been a general practice that an organic photoreceptor is negatively charged while the toner is positively charged. If a positively charged toner is transferred to the transfer film, the transfer efficiency is improved by using, as an antistatic agent provided on the transfer film, an anionic antistatic agent such as alkylbenzenesulfonate, since it exhibits a great electrical interaction with the toner.

In the full-color electrophotographic process, the resolving power must be drastically enhanced as compared with the black-and-white electrophotographic process. In the full-color electrophotographic process, an organic photoreceptor is used as a photoreceptor, and the photoreceptor is negatively charged. In order to enhance the resolving power, an image writing process is employed. That the negative electric charge on the image portion in the negatively charged photoreceptor is imagewise eliminated by laser so that charge-free portions occur in the background of negative charge. This charge-free portion serves as if it has a positive charge to adsorb a negatively charged toner.

In this process, a cationic antistatic agent which exhibits a great interaction with a negatively charged toner can be effective for the enhancement of the transferability and the inhibition of toner retransfer on the transfer film.

Examples of such a cationic antistatic agent include heterocyclic amines, ammonium salts, sulfonium salts, phosphonium salts, betainic amphoteric salts, etc. Particularly preferred among these cationic antistatic agents are quaternary ammonium salts.

Preferred examples of the such quaternary ammonium salts include compounds represented by formula (II):

$$R_1-A-R_2-\overset{\overset{R_3}{|}}{\underset{\underset{R_4}{|}}{N^{\oplus}}}-R_5.X^{\ominus} \qquad \text{(II)}$$

In formula (II), $R_1$ represents a $C_{6-22}$ alkyl group, alkenyl group or alkinyl group, and $R_2$ represents a $C_{1-6}$ alkyl group, alkenyl group or alkinyl group. $R_3$, $R_4$ and $R_5$ may be the same or different and each represents an aliphatic group, aromatic group or heterocyclic group. The aliphatic group as mentioned herein means a straight-chain, branched or cyclic alkyl group, alkynyl group or alkenyl group. The aromatic group as mentioned herein means a monocyclic benzene group or condensed polycyclic aryl group. These groups may contain substituents such as a hydroxyl group.

In formula (II), A represents an amide bond, ether bond, ester bond or phenyl group but may be omitted. $X^-$ represents a halogen atom, nitric acid ion or sulfuric acid ion. These ions may have substituents.

Specific examples of compounds represented by formula (II) will be set forth below.

$$C_{18}H_{37}\overset{\oplus}{N}\equiv(CH_3)_3 \quad Cl^{\ominus}$$

-continued

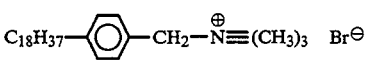

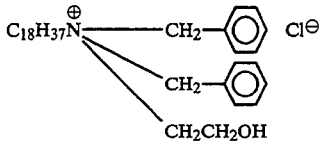

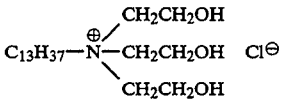

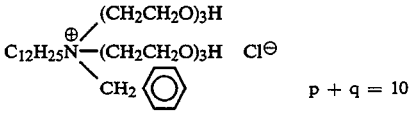

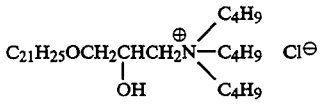

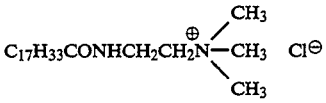

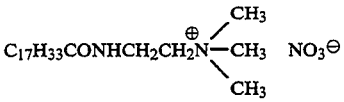

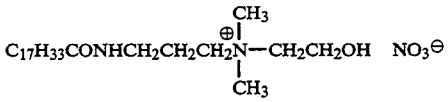

-continued

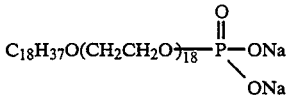

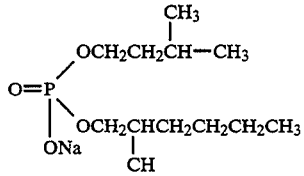

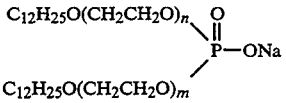

(n + m = 4)

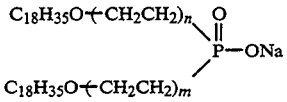

(n + m = 8)

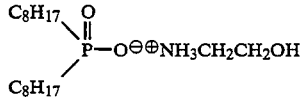

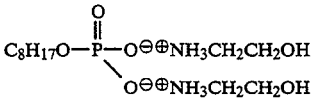

Examples of an anionic antistatic agent include a carboxylic acid or its salt, a sulfonic acid or its salt, a sulfate and a phosphate. Among these, a phosphate is preferably used as an anionic antistatic agent.

Preferred examples of such a phosphate type antistatic agent include compounds represented by formula (III):

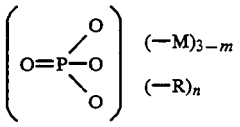

(III)

In formula (III), R represents a $C_{6-22}$ alkyl group, alkenyl group or alkynyl group, M represents a metallic or ammonium cation, m represents an integer 1 or 2, and n represents an integer of 1, 2 or 3.

Specific examples of compounds represented by formula (III) will be set forth below.

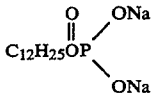

The amount of the antistatic agent to be used is generally in the range of 1 mg/m$^2$ to 50 mg/m$^2$. The optimum surface resistivity is in the range of $10^{10}\,\Omega$ to $10^{12}\,\Omega$. The antistatic agent may be used in admixture with the transparent resin or may be coated on the transparent resin layer. The amount of the antistatic agent to be used depends on whether it is used in admixture with the transparent resin or coated on the transparent resin layer.

In the electrophotographic transfer film of the present invention, intermediate adhesion layer 103 may be provided interposed between plastic film 101 and transparent resin layer 102 as shown in FIGS. 2 and 4. The intermediate adhesion layer is provided so as to enhance the adhesion between the plastic film and the transparent resin layer so that the fixed toner image is not peeled off the plastic film with the transparent resin layer after fixing.

The intermediate adhesion layer can be made of a resin which is compatible with the plastic film and the transparent resin layer and is so heat-resistant that it does not melt by heat upon fixing. Examples of resins which can be used for the intermediate adhesion layer include polyester resin, acrylic ester resin, methacrylic ester resin, styrene-acrylic ester copolymer, and styrene-methacrylic ester copolymer. The intermediate adhesion layer has such a thickness that a sufficient adhesion can be provided between the transparent resin layer and the plastic film. However, if the intermediate adhesion layer is too thick, it reduces the effect of the toner sinking in the transparent resin layer. Thus, the thickness of the intermediate adhesion layer is preferably in the range of 0.05 to 0.5 μm.

In the present invention, if transparent resin layer 102 is provided on one side of the plastic film, sliding layer 104 is preferably provided on the other side thereof as shown in FIGS. 1 and 2.

Methods for the preparation of an electrophotographic transfer film of the present invention will be described hereinafter.

The resin to be used for the formation of the transparent resin layer is dissolved in single or a mixture of two or more organic solvents selected from alcohols such as methanol and ethanol, ketones such as acetone and methyl ethyl ketone and chlorinated hydrocarbons such as methylene chloride, ethylene chloride and tetrachloroethane. The solution is coated on the plastic film by a coating method such as bar coating method, dip coating method, spray coating method and spin coating method, and then dried. When the transparent resin layer is coated on the plastic film, a swelling agent for the plastic film may be used as necessary to enhance the adhesion between the transparent resin layer and the plastic film.

Examples of swelling agents for plastic film include phenol, resorcin, orthochlorophenol, parachlorophenol, cresol, other phenol derivatives, benzoic acid, salicylic acid, salicylic ester, monochloroacetic acid, trichloroacetic acid, trifluoroacetic acid, 2-nitropropanol, benzyl alcohol, benzoaldehyde, acetonitrile acetone, acetophenone, benzoamide, benzonitrile, and nicotinic methyl. The amount of the swelling agent to be used is preferably in the range of 2 to 10% by weight based on the total weight of the solvents.

Furthermore, the transparent resin layer 102 may contain a filler for adjusting the inter-film friction coefficient or an antistatic agent for inhibiting frictional charging as necessary. Examples of such a filler include finely divided grains of silica, starch and alumina, and powder of plastic such as polyethylene, polyester, polyacrylonitrile and polymethyl methacrylate. The amount of the matting agent to be used is preferably in the range of 0.1 to 10% by weight based on the weight of the resin used.

Besides the above mentioned antistatic agents, alkylbenzoimidazolesulfonates, naphthalinesulfonates, carboxylic sulfone ester, phosphoric ester, etc. may be used as antistatic agents as necessary, If the intermediate adhesion layer is provided, its formation may be carried out using the same solvents and coating method as used for the transparent resin layer.

The toner for use in the color image formation process of the present invention will be described hereinafter. The toners for use in color electrophotographic apparatus are required to exhibit excellent melt properties and color mixing properties under the application of heat. Therefore, a sharp-melting toner with a low softening point and a low apparent melt viscosity at the fixing temperature is preferably used. In connection with the foregoing electrophotographic transfer film and transparent resin layer, the toner binding resin preferably exhibits an apparent melt viscosity definitely higher than the resin constituting the transparent resin layer. In particular, the toner binding resin preferably exhibits an apparent melt viscosity of $8\times10^4$ to $3\times10^5$ poise, preferably $9\times10^4$ to $2\times10^5$ poise at a temperature of 100° C. in the light of adaptability to the electrophotographic transfer film and color mixing properties between toners.

The toner is prepared by a process which comprises melt-kneading a binding resin such as polyester resin and styrene-acryl ester resin, a coloring agent (e.g., dye, sublimatable dye), and a material to be used for the formation of toner such as charge controlling agent, followed by crushing and classifying. If necessary, an addition step for adding various additives (e.g., hydrophobic colloidal silica) to the toner may be added to the process.

In the light of fixability and sharp melting properties, the color toner preferably comprises the binding resin of the same kind as in the transparent resin layer, i.e., a polyester resin comprising a bisphenol derivative represented by the foregoing formula (I) or a polyester resin comprising a substituted compound of bisphenol derivative of formula (I) as a diol component and at least one of 2 or more valent carboxylic acid, its anhydride and its lower alkyl ester. The polyester resin preferably exhibits a softening point of 75° to 150° C., and more preferably 80° to 120° C.

In the light of the relationship between the toner and the electrophotographic transfer film, the toner binding resin is preferably selected such that its apparent melt viscosity at 100° C. is definitely greater than that of the resin used in the transparent resin layer in the transfer film.

The color image formation process will be described hereinafter.

Figure 5:
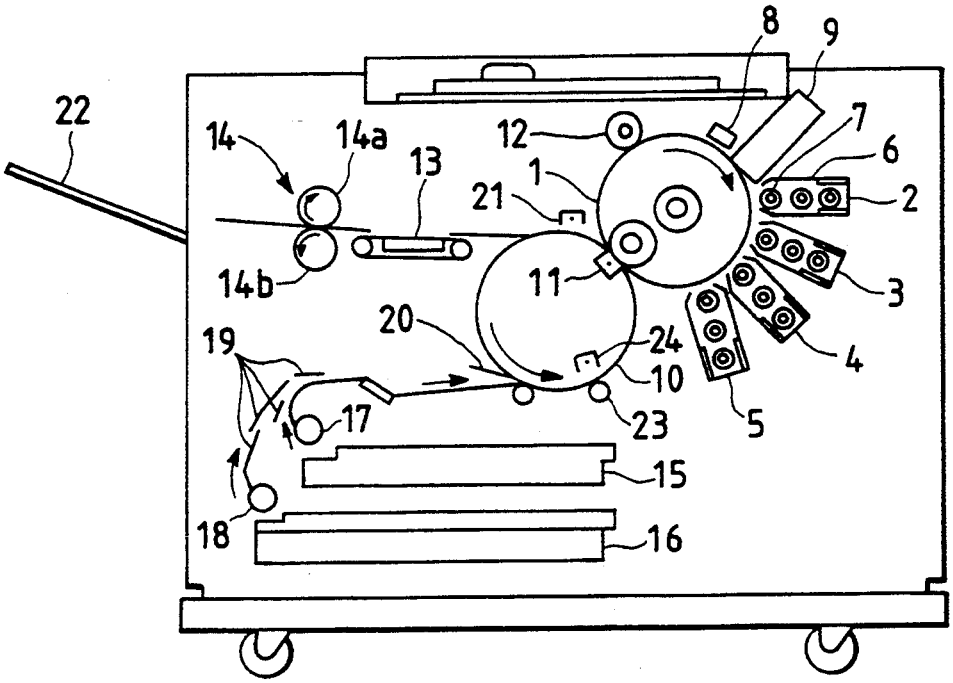
FIG. 5 is a schematic section of an electrophotographic apparatus for use in the formation of an image in accordance with the present invention.

FIG. 5 illustrates a schematic section of one embodiment of an electrophotographic apparatus capable of forming a full-color image which can be used in the present invention. This electrophotographic apparatus is roughly comprised of a transfer material conveying system provided over a zone from the bottom of the body of the apparatus (bottom of FIG. 5) to an approximately central portion of the body of the apparatus, a latent image forming portion provided close to transfer drum 10 constituting the transfer material conveying system, and a developing apparatus provided close to the latent image forming portion.

The transfer material conveying system consists of feed trays 15 and 16 provided at the bottom of the body of the apparatus, paper feeding rollers 17 and 18 provided approximately above these trays, paper feed guides 19 and 20 provided close to these paper feeding rollers, transfer drum 10 provided close to paper feed guide 20, which is provided with transfer material separation/charging apparatus 21 in the vicinity of the outer periphery thereof and transferring apparatus 11 and electrode 24 on the inner periphery thereof and is rotatable in the direction indicated by the arrow, contact roller 23 provided in contact with the outer periphery of transfer drum 10, conveying apparatus 13, fixing apparatus 14 provided close to conveying end of the conveying apparatus 13, and detachable discharge tray 22.

The latent image forming portion has electrostatic latent image retaining unit (photoreceptor dry) 1 provided in contact with the outer periphery of transfer drum 10 which is rotatable in the direction indicated by the arrow, charging apparatus 8 provided in the vicinity of the outer periphery of the electrostatic latent image retaining unit, writing apparatus 9 equipped with an imagewise exposure means for forming an electrostatic latent image on the outer periphery of the electrostatic latent image retaining unit such as laser beam scanner and an imagewise exposure/reflection means such as polygon mirror, and cleaning apparatus 12.

The developing apparatus is composed of a black developing apparatus 2, magenta developing apparatus 3, cyan developing apparatus 4 and yellow developing apparatus 5, each composed of developer carrier 7 and housing 6, for rendering the electrostatic latent image formed on the outer periphery of the electrostatic latent image retaining unit visible (i.e., developing) at the position opposite to the outer periphery of electrostatic latent image retaining unit 1.

The sequence of image formation by the electrophotographic apparatus having the foregoing configuration will be described with reference to the case of full-color mode by way of example. When electrostatic latent image retaining unit 1 rotates in the direction indicated by the arrow, the surface of electrostatic latent image retaining unit 1 is uniformly charged by charging apparatus 8. Once the electrostatic latent image retaining unit is uniformly charged by the charging apparatus 8, an electrostatic latent image is formed thereon by laser beam modulated by a black image signal from an original (not shown) via writing apparatus 9. The electrostatic latent image is then developed by black developing apparatus 2.

A transfer material which has been conveyed from feed tray 15 or 16 through paper feed roller 17 or 18 and paper feed guide 19 or 20 is then electrostatically wound on transfer drum 10 by the action of electrode 24 provided opposite to contact roller 23. Transfer drum 10 rotates in the direction indicated by the arrow in synchronism with electrostatic latent image retaining unit 1. The image developed by black developing apparatus 2 is then transferred to the transfer material by transferring apparatus 11 in the position at which the outer periphery of electrostatic latent image retaining unit 1 contacts with the outer periphery of transfer drum 10. Transfer drum 10 continues to rotate to prepare for the transfer of the next color (magenta in FIG. 5).

Electrostatic latent image retaining unit 1 is destacized by a charger for destacization (not shown), cleaned by cleaning apparatus 12, again charged by the charging apparatus 8, and then imagewise exposed by a magenta image signal in the same manner as mentioned above. The electrostatic latent image formed by the imagewise exposure by the magenta image signal is developed by magenta developing apparatus 3 to a developed image. Subsequently, the above mentioned process is repeated each for cyan and yellow. When the transfer of four colors is finished, the multi-color developed image formed on the transfer material is destacized by charging/separation apparatus 21, conveyed to the fixing apparatus 14 by means of paper conveying apparatus 13, and then fixed by heat under pressure. Thus, a sequence of the full-color image formation is finished.

The main part of fixing apparatus 14 comprises heat roll **14*a* and pressure roll 14*b* each having the similar structure. Heat roll 14*a* is equipped with a 500-W colt lamp inside and comprises a substrate roll formed of a steel core material with an outer diameter of 44 mm and a fluorine rubber having a JIS hardness of 60° and a thickness of 40 μm (e.g., Byron rubber produced by Du Pont) provided on the substrate roll. Pressure roll 14*b* has the similar structure as heat roll 14*a*** except that the substrate roll is formed of a steel core material having an outer diameter of 48 mm and a 1-mm thick inner elastic layer formed of silicone rubber is provided on the substrate roll.

In order to render the surface of the fluorine rubber highly releasing, the heat roll contacts with an oil donor roll made of silicone rubber as a release agent supplying means for supplying a release agent made of dimethyl polysiloxane containing a functional group (e.g., amino group). The oil donor roll is generally supplied with the release agent from an oil pickup roll dipped in an oil pan.

Heat roll **14*a* and pressure roll 14*b*** are pressed against each other by a pressure mechanism to form a nip width of 6 mm therebetween. The two rolls are both arranged to have a surface temperature of 150° C. and rotate in the direction indicated by the respective arrow at a surface speed of 60 mm/sec.

The present invention will be further described in the following examples, but the present invention should not be construed as being limited thereto.

EXAMPLE 1

Onto a 100-μm thick polyester film having a heat deformation temperature of 152° C. and a maximum working temperature of 150° C. were coated one of methyl ethyl ketone solutions of polyester resin A with an apparent melt viscosity of $1\times10^3$ poise at 100° C., polyester resin B with an apparent melt viscosity of $5\times10^3$ poise at of 100° C., polyester resin C with an apparent melt viscosity of $4\times10^4$ poise at 100° C. and a polyester resin D with an apparent melt viscosity of $7\times10^4$ P at a temperature of 100° C. by a bar coater in amounts such that transparent resin layers with dried thicknesses of 0.5 μm, 1 μm, 2 μm, 8 μm and 20 μm were formed. Thus, electrophotographic transfer films FA, FB, FC and FD were obtained. Polyester resin A was a copolymer of 40% by weight of bisphenol A, 10% by weight of fumaric acid and 50% by weight of isopropylene glycol; polyester resin B was a copolymer of 25% by weight of a bisphenol derivative, 22% by weight of fumaric acid and 53% by weight of isopropylene glycol; polyester resin C was a copolymer of 23% by weight of terephthalic acid, 27% by weight of bisphenol A and 50% by weight isopropylene glycol; and polyester resin D was a copolymer of 35% by weight of terephthalic acid, 15% by weight of bisphenol A and 50% by weight of isopropylene glycol.

In electrophotographic transfer films FA, FB, FC and FD, as a filler, polyethyl methacrylate in an amount of 1% by weight based on the weight of polyester resin was added. Furthermore, as an antistatic agent, a phosphoric alkyl surface active agent in an amount of 0.5% by weight based on the weight of polyester resin was added.

To 96 parts by weight of a polyester resin PT (solubility parameter: about 11) with an apparent melt viscosity of $1\times10^5$ poise at 100° C. were added 1 part by weight of an electric charge controlling agent and 3 parts by weight of a cyan pigment to prepare a cyan toner. Likewise, to 96 parts by weight of the polyester resin were added 1 part by weight of the electric charge controlling agent and 3 parts by weight of a magenta pigment to prepare a magenta toner. To 96 parts by weight of the polyester resin were added 1 part by weight of the electric charge controlling agent and 3 parts by weight of a yellow pigment to prepare a yellow toner. To 96 parts by weight of the polyester resin were added 1 part by weight of the electric charge controlling agent and 3 parts by weight of a black pigment to prepare a black toner.

These cyan, magenta, yellow and black toners each had a volume-average grain diameter of 7 μm. For the measurement of the volume-average grain diameter of toner, Type TA-II coal tar counter (produced by Coal Tar) was used. With an aperture having a diameter of 100 μm, the grain size distribution of grains having a diameter of 2 to 50 μm was measured to determine the volume-average grain diameter.

Using the electrophotographic transfer films and color toners thus obtained and the electrophotographic apparatus shown in FIG. 5, an unfixed full-color toner image with cyan, magenta, yellow and black toners combined and a toner weight of 2 mg/cm$^2$ was formed on the transfer films. The unfixed full-color toner image was then heat-fixed under pressure at a heat fixing roll temperature of 150° C. for an average heating time of 100 msec. to form a fixed full-color image on the transfer films. The full-color image for OHP projection was then evaluated for the lightness, saturation and presence of pseudo-outline. At the same time, the fixing of the full-color toner was also evaluated (including the drop in the fixing due to peeling of the transparent resin layer from the plastic film).

For the evaluation of the lightness and saturation of the image for OHP projection, conversion was made from three stimulated values X, Y and X of projected color based on JIS Z8722 to CIE1976 (L*a*b*) color space to determine lightness (L*) and saturation (C*) of the following formula:

$$(C^* = \sqrt{a^{*2} + b^{*2}})$$

The measurement of spectral transmission was carried out by means of a spectrophotometer with a standard light A as a light source. For the color matching function, values in the field of 2 degrees were used. For the evaluation of lightness L* and saturation C*, patches with an input dot area ratio of 100% (CiN 100%) and 50% (CiN 50%) were outputted, and L* and C* of their projected colors were then measured. (The other colors were also evaluated, and similar results were obtained. Therefore, only the results of cyan are set forth.)

For the evaluation of pseudo-outline, a natural image such as person was formed on OHP films through which it was then projected by means of OHP over a screen where it was visually observed for pseudo-outline.

The fixing degree was evaluated as follows.

1. A fuser oil attached to the transfer film on which a color image had been fixed was clearly removed by a cloth or the like.
2. A cellophane adhesive tape (Nichiban CT-18) is put on the fixed image.
3. The cellophane adhesive tape is peeled off the fixed image (peel angle: 180 degree; peel time: 1 sec.)
4. The peeling state of the image portion thus tested is visually evaluated.

The results of the evaluation are set forth in Table 1.

TABLE 1

| | Transparent resin layer | | | | | | | | | |
|---|---|---|---|---|---|---|---|---|---|---|
| Specimen | Thickness (μm) | Apparent melt viscosity (Poise) | Molten toner inclination (degree) | Lightness (L*) CiN100 | Lightness (L*) CiN50 | Saturation (C*) CiN100 | Saturation (C*) CiN50 | Pseudo-outline[1)] | Fixing degree[2)] | Peel of transparent resin layer due to film bending[3)] |
| $F_A$ | 0.5 | $1 \times 10^3$ | 42 | 54.6 | 60.3 | 77.5 | 56.7 | 4 | 3 | 3 |
| | 1.0 | $1 \times 10^3$ | 37 | 55.8 | 62.5 | 83.6 | 64.3 | 3 | 3 | 3 |
| | 2.0 | $1 \times 10^3$ | 34 | 56.2 | 63.2 | 84.1 | 65.2 | 1 | 3 | 3 |
| | 8.0 | $1 \times 10^3$ | 32 | 55.9 | 62.7 | 83.6 | 64.4 | 1 | 3 | 3 |
| | 20.0 | $1 \times 10^3$ | 31 | 55.5 | 62.2 | 83.0 | 63.9 | 1 | 5 | 5 |
| $F_B$ | 0.5 | $5 \times 10^3$ | 43 | 54.7 | 60.5 | 77.5 | 56.8 | 4 | 3 | 3 |
| | 1.0 | $5 \times 10^3$ | 37 | 55.6 | 62.5 | 83.5 | 64.2 | 2 | 2 | 3 |
| | 2.0 | $5 \times 10^3$ | 35 | 56.0 | 63.0 | 84.0 | 65.0 | 1 | 2 | 3 |
| | 8.0 | $5 \times 10^3$ | 32 | 55.7 | 62.6 | 83.6 | 64.3 | 1 | 2 | 3 |
| | 20.0 | $5 \times 10^3$ | 31 | 55.5 | 62.3 | 83.2 | 64.0 | 1 | 5 | 5 |
| $F_C$ | 0.5 | $4 \times 10^4$ | 43 | 54.6 | 60.5 | 77.4 | 56.7 | 4 | 3 | 3 |
| | 1.0 | $4 \times 10^4$ | 38 | 55.5 | 62.3 | 83.0 | 63.9 | 2 | 2 | 3 |
| | 2.0 | $4 \times 10^4$ | 36 | 56.9 | 62.8 | 83.8 | 64.7 | 1 | 2 | 3 |
| | 8.0 | $4 \times 10^4$ | 33 | 55.8 | 62.8 | 83.7 | 64.8 | 1 | 2 | 3 |
| | 20.0 | $4 \times 10^4$ | 31 | 55.4 | 62.0 | 83.1 | 63.9 | 1 | 5 | 5 |
| $F_D$ | 0.5 | $7 \times 10^4$ | 45 | 54.5 | 60.3 | 77.2 | 56.5 | 4 | 3 | 3 |
| | 1.0 | $7 \times 10^4$ | 40 | 55.5 | 62.0 | 83.0 | 63.7 | 3 | 2 | 3 |
| | 2.0 | $7 \times 10^4$ | 38 | 55.7 | 62.6 | 83.6 | 64.4 | 2 | 2 | 3 |
| | 8.0 | $7 \times 10^4$ | 36 | 55.6 | 62.6 | 83.5 | 64.3 | 2 | 2 | 3 |
| | 20.0 | $7 \times 10^4$ | 33 | 55.3 | 62.0 | 83.0 | 63.8 | 2 | 5 | 5 |

Note)
[1)]Grade of pseudo-outline:
1: No pseudo-outline;
2: Little pseudo-outline;
3: Acceptable level;
4: Considerable pseudo-outline;
5: Extremely considerable pseudo-outline
[2)]Grade of fixing:
1: No image peeling;
2: Little image peel;
3: Acceptable level;
4: Considerable peel;
5: Extremely considerable peel
[3)]Grade of peel of transparent resin layer due to film bending:
1: No peel of transparent resin layer;
2: Little peel;
3: Acceptable level;
4: Considerable peel;
5: Extremely considerable peel The results set forth in Table 1 show that when a resin having an apparent melt viscosity definitely lower than the toner binding resin at the toner fixing temperature and a molten toner inclination angle of 40 degrees or less at the toner fixing temperature is used in the transparent resin layer, a full-color image with excellent lightness, saturation and fixing and little pseudo-outline and little peel of the transparent resin layer due to film bending can be obtained with the thickness of the transparent resin layer ranging from 1 to 8 μm. It can also be understood that the apparent melt viscosity of the transparent resin layer at the fixing temperature is preferably in the range of $1\times10^3$ to $7\times10^4$ poise, and when the apparent melt viscosity is in a range of $5\times10^3$ to $4\times10^4$ poise, it is particularly preferred with respect to the inhibition of pseudo-outline.

The thickness of the transparent resin layer is preferably in the range of 1 μm to 8 μm. If the thickness of the transparent resin layer falls below 1 μm, much false outline tends to occur. If the thickness of the transparent resin layer exceeds 8 μm, it disadvantageously tends to reduce the fixing degree and increases the peel of the transparent resin layer due to film bending. It can be understood that the thickness of the transparent resin layer is particularly preferably in the range of 2 μm to 8 μm in the light of pseudo-outline.

EXAMPLE 2

On a 100-μm thick polyester film having a heat deformation temperature of 152° C. and a maximum working temperature of 150° C. were provided intermediate adhesion layers with a thicknesses of 0.01 μm, 0.05 μm, 0.5 μm, and 1.0 μm, respectively. On these intermediate adhesion layers were each formed a transparent resin layer comprising the polyester resin B, filler and an antistatic agent (anionic sodium benzenesulfonate) as used in Example 1 in such a manner that the dried thickness thereof reached 2 μm to obtain electrophotographic transfer films FE. These intermediate adhesion layers were composed of a polyester resin made of a copolymer of terephthalic acid, isophthalic acid, neopentyl glycol and ethylene glycol. As a swelling agent for the polyester film, parachlorophenol in an amount of 10% by weight was added. As a solvent, methyl ethyl ketone was used.

Using the same color toner and method as used in Example 1, a full-color fixed image was formed on these transfer films. The properties of OHP image, fixing degree, etc. were then evaluated in the same manner as in Example 1. The results of the evaluation are set forth in Table 2.

TABLE 2

| Transparent resin layer | | | | | | | | | | |
|---|---|---|---|---|---|---|---|---|---|---|
| Thickness (μm) | Apparent melt viscosity (Poise) | Molten toner inclination (degree) | Thickness of intermediate adhesion layer (μm) | Lightness (L*) CiN100 | Lightness (L*) CiN50 | Saturation (C*) CiN100 | Saturation (C*) CiN50 | Pseudo-outline[1)] | Fixing degree[2)] | Peel of transparent resin layer due to film bending[3)] |
| | | | 0.01 | 56.0 | 63.0 | 84.0 | 65.0 | 1 | 2 | 3 |
| | | | 0.05 | 56.1 | 63.0 | 84.1 | 65.0 | 1 | 1 | 1 |
| 2.0 | $5\times10^3$ | 35 | 0.5 | 55.9 | 63.1 | 84.0 | 65.1 | 1 | 1 | 1 |
| | | | 1.0 | 55.5 | 62.4 | 83.4 | 63.9 | 3 | 1 | 1 |

Table 2 shows that the transfer films having an intermediate adhesion layer with a thickness of 0.05 to 0.5 μm can provide improvements in the fixing degree and the inhibition of peel of the transparent resin layer due to film bending without causing an increase in pseudo-outline and deterioration in lightness and saturation. If the thickness of the intermediate adhesion layer falls below 0.05 μm, the fixing degree and the inhibition of peel of the transparent resin layer leave much to be desired. If the thickness of the intermediate adhesion layer exceeds 0.5 μm, the fixing degree and the inhibition of peel of the transparent resin layer can be improved, but there tends to be caused increase in pseudo-outline and deterioration in lightness and saturation. Therefore, the thickness of the intermediate adhesion layer is preferably in the range of 0.05 to 0.5 μm.

EXAMPLE 3

On a 100-μm thick polyester film having a heat deformation temperature of 152° C. and a maximum working temperature of 150° C. was coated a solution of polyester resin B as used in Example 1 in such an amount that the dried thickness thereof reached 2 μm except that the surface resistivity thereof was altered by changing the added amount of the filler and sodium alkylbenzenesulfonate as an antistatic agent. Thus, electrophotographic transfer film FF was obtained.

Electrophotographic transfer film FG was obtained in the same manner as transfer film FF except that the surface resistivity was altered by the use of a cationic stearacidepropylenedimethyl-β-hydroxyethylammonium nitrate as an antistatic agent.

Using the same color toners and method as used above, a full-color fixed image was formed on these transfer films to evaluate toner retransfer and the presence of discharge mark on OHP image. The results are set forth in Table 3.

TABLE 3

| Specimen | Thickness (μm) | Apparent melt viscosity (Poise) | Molten toner inclination angle (degree) | Surface resistivity (Ω) | Added amount of antistatic agent ($mg/m^2$) | Discharge mark | Toner retransfer |
|---|---|---|---|---|---|---|---|
| $F_F$ | 2.0 | $5\times10^3$ | 35 | $10^{13}$ | 5 | XX | ○ |
| | | | | $10^{12}$ | 10 | X | ○ |
| | | | | $10^{11}$ | 15 | ○ | ○ |
| | | | | $10^{10}$ | 20 | ○ | X |
| $F_G$ | 2.0 | $5\times10^3$ | 35 | $10^{12}$ | 10 | X | ○ |
| | | | | $10^{11}$ | 15 | ○ | ○ |
| | | | | $10^{10}$ | 20 | ○ | ○ |

TABLE 3-continued

| Specimen | Thickness (μm) | Apparent melt viscosity (Poise) | Molten toner inclination angle (degree) | Surface resistivity (Ω) | Added amount of antistatic agent (mg/m²) | Discharge mark | Toner retransfer |
|---|---|---|---|---|---|---|---|
| | | | | $10^9$ | 25 | ○ | X |

XX . . . Poor,
X . . . Fair,
○ . . . Excellent

Table 3 shows that the use of an anionic alkylbenzenesulfonate antistatic agent causes toner retransfer at a surface resistivity of $10^{10}$ Ω or less and the range of optimum surface resistivity within which both discharge mark and toner retransfer can be inhibited is thus narrow.

The use of a cationic antistatic agent can widen this range.

COMPARATIVE EXAMPLE

Onto a 100-μm thick polyester film having a heat deformation temperature of 152° C. and a maximum working temperature of 152° C. were coated methyl ethyl ketone solutions of polyester resin F (Vylon GK150 produced by Toyobo Co., Ltd.) with an apparent melt viscosity of $2\times10^4$ poise at a temperature of 100° C. and polyand polyester resin G (Vylon 200 composed of 24.2% of terephthalic acid, 26.3% of isophthalic acid, 22.1% of ethylene glycol and 27.4% of neopentyl glycol, produced by Toyobo Co., Ltd.) with an apparent melt viscosity of $8\times10^5$ poise at 100° C. by a bar coater in amounts such that transparent resin layers with dried thicknesses of 1 μm, 2 μm, and 8 μm were formed. Thus, electrophotographic transfer films FH and FI, respectively, were obtained. A filler was added in the same manner as in Example 3. As an antistatic agent, a cationic antistatic agent was added in an amount of 15 mg/m² to provide a surface resistivity of $10^{22}$ Ω.

Using the same color toners and method as used in Example 1, a full-color fixed image was formed on these electrophotographic transfer film. Various evaluations were effected in the same manner as in Example 1.

The results are set forth in Table 4.

TABLE 4

| Specimen | Transparent resin layer: Thickness (μm) | Apparent melt viscosity (Poise) | Molten toner inclination (degree) | Lightness (L*) CiN100 | Lightness (L*) CiN50 | Saturation (C*) CiN100 | Saturation (C*) CiN50 | Pseudo-outline | Fixing degree | Peel of transparent resin layer due to film bending |
|---|---|---|---|---|---|---|---|---|---|---|
| $F_H$ | 1 | $2\times10^4$ | 48 | 53.8 | 58.7 | 76.0 | 55.5 | 5 | 3 | 3 |
| | 2 | $2\times10^4$ | 45 | 54.0 | 58.9 | 76.4 | 55.9 | 5 | 3 | 3 |
| | 8 | $2\times10^4$ | 43 | 54.0 | 59.0 | 76.5 | 56.0 | 4 | 3 | 3 |
| $F_I$ | 1 | $8\times10^5$ | 50 | 52.9 | 58.0 | 75.5 | 54.9 | 5 | 3 | 3 |
| | 2 | $8\times10^5$ | 48 | 53.5 | 58.5 | 76.0 | 55.5 | 5 | 3 | 3 |
| | 8 | $8\times10^5$ | 47 | 53.0 | 58.3 | 75.8 | 55.3 | 5 | 3 | 3 |

Table 4 shows that the transfer film FH comprising in the transparent resin layer a resin having an apparent melt viscosity definitely higher than the toner binding resin at the toner fixing temperature and a molten toner inclination angle of 40 degrees or more at the toner fixing temperature shows remarkable pseudo-outline and deterioration in lightness and saturation and thus cannot provide a desired full-color projection image.

Similarly, the transfer film FG comprising in the transparent resin layer a resin having an apparent melt viscosity lower than the toner binding resin at the toner fixing temperature and a molten toner inclination angle of 40 degrees or more at the toner fixing temperature shows remarkable pseudo-outline and deterioration in lightness and saturation and thus cannot provide a desired full-color projection image.

With a transparent resin layer having the above mentioned configuration, the electrophotographic transfer film of the present invention provides excellent fixing of a full-color image and can easily form thereon a pseudo-outline-free full-color projection image with a high lightness and saturation and an excellent color tone reproducibility in an electrophotographic color image formation process.

While the invention has been described in detail and with reference to specific embodiments thereof, it will be apparent to one skilled in the art that various changes and modifications can be made therein without departing from the spirit and scope thereof.

What is claimed is:

1. An electrophotographic process for forming an image comprising the steps of: adsorbing a charged toner on an electrostatic latent image retaining unit, and transferring and fixing said charged toner to an electrophotographic transfer film, said transferring and fixing being conducted twice or more, said transfer film comprising a plastic film having a heat resisting temperature of 100° C. or higher having on at least one side thereof a transparent resin layer comprising a pollyester resin or a styrene-acryl resin which exhibits a compatibility with a binding resin comprising a polyester resin or styrene-acryl ester binding resin contained in said toner to be fixed at the toner fixing temperature and a lower apparent melt viscosity than said binding resin at the toner fixing temperature.

2. An electrophotographic process as claimed in claim 1, wherein said transparent resin layer has a molten toner inclination angle of 40 degrees or less with the toner to be fixed at said toner fixing temperature.

3. A electrophotographic process as claimed in claim 1, wherein an intermediate adhesion layer is provided between said plastic film and said transparent resin layer.

4. A electrophotographic process as claimed in claim 2, wherein an intermediate adhesion layer is provided between said plastic film and said transparent resin layer.

5. An electrophotographic process as claimed in claim 1, wherein said toner is negatively charged, and said transparent resin layer comprises a cationic antistatic agent.

6. An electrophotographic process as claimed in claim 2, wherein said toner is negatively charged, and said transparent resin layer comprises a cationic antistatic agent.

7. An electrophotographic process as claimed in claim 1, wherein said toner is positively charged, and said transparent resin layer comprises an anionic antistatic agent.

8. An electrophotographic process as claimed in claim 2, wherein said toner is positively charged, and said transparent resin layer comprises an anionic antistatic agent.

9. An electrophotographic process as claimed in claim 1, wherein said toner comprises a binding resin selected from the group consisting of a polyester resin and a styrene-acryl ester resin.

10. An electrophotographic process as claimed in claim 1, wherein said transparent resin layer comprises a resin selected from the group consisting of a polyester resin, a styrene-acryl ester resin, an epoxy resin, a polyurethane resin, a polymethyl methacrylate resin, a vinyl chloride resin and a vinyl chloride-vinyl acetate copolymer.

11. An electrophotographic process as claimed in claim 1, wherein said transparent resin layer comprises a polyester resin comprising a bisphenol derivative represented by formula (I) or a substituted compound of a bisphenol derivative represented by formula (I) as a diol component and at least one of a 2 or more valent carboxylic acid, its anhydride and its lower alkyl ester as an acid component:

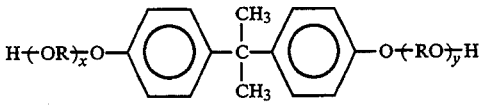

(I)

wherein R represents an ethylene group or a propylene group; and x and y each represents an integer of 1 or more, provided that the average of the sum of x and y is from 2 to 10.

12. An electrophotographic process as claimed in claim 1, wherein said toner comprises a binding resin comprising a polyester resin comprising a bisphenol derivative represented by formula (I) or a polyester resin comprising a substituted compound of a bisphenol derivative represented by formula (I) as a diol component and at least one of a 2 or more valent carboxylic acid, its anhydride and its lower alkyl ester as an acid component:

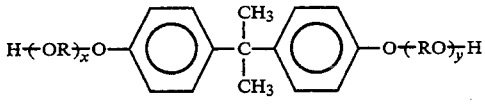

(I)

wherein R represents an ethylene group or a propylene group; and x and y each represents an integer of 1 or more, provided that the average of the sum of x and y is from 2 to 10.

13. A process for forming an image as claimed in claim 1, wherein said transparent resin layer has a molten toner inclination angle of 40 degrees or less with the toner to be fixed at said toner fixing temperature and an apparent melt viscosity of from $1\times10^3$ to $7\times10^4$ poise at 100° C.

14. An electrophotographic transfer film having a charged toner affixed thereto by an electrophotographic process in which the charged toner is adsorbed by an electrostatic latent image retaining unit and then transferred and fixed to said transfer film, said transfer film comprising a plastic film having a heat resisting temperature of 100° C. or higher having on at least one side thereof a transparent resin layer comprising a polyester resin or a styrene-acryl resin which exhibits a compatibility with a binding resin comprising a polyester resin or styrene-acryl ester binding resin contained in said toner to be fixed at the toner fixing temperature and a lower apparent melt viscosity than said binding resin at the toner fixing temperature.

15. An electrophotographic process as claimed in claim 9, wherein said transparent resin layer comprises a resin selected from the group consisting of a polyester resin and a styrene-acryl ester resin.

16. An electrophotographic process as claimed in claim 15, wherein said toner comprises a polyester resin as a binding resin and said transparent resin layer comprises a polyester resin.

17. An electrophotographic process as claimed in claim 15, wherein said toner comprises a styrene-acryl resin as a binding resin and said transparent resin layer comprises a styrene-acryl resin.

* * * * *